United States Patent [19]

Garner et al.

[11] 4,025,089

[45] May 24, 1977

[54] PRESSURE-SENSITIVE COPYING OR RECORDING MATERIAL

[75] Inventors: Robert Garner, Ramsbottom Bury, England; Jean-Claude Petitpierre, Kaiseraugst, Switzerland

[73] Assignee: Ciba-Geigy Corporation, Ardsley, N.Y.

[22] Filed: Aug. 3, 1976

[21] Appl. No.: 711,195

[30] Foreign Application Priority Data

Aug. 12, 1975 Switzerland ..... 10466/75

[52] U.S. Cl. ..... 282/27.5; 260/240 G; 260/566 F; 427/150; 427/151; 428/323; 428/411; 428/914

[51] Int. Cl.[2] ..... B41M 5/22

[58] Field of Search ..... 282/27.5; 427/146, 150, 427/151, 152, 153; 428/323, 326, 327, 411, 537, 913, 914; 260/566 F, 240 G

[56] References Cited

UNITED STATES PATENTS

| | | | |
|---|---|---|---|
| 3,066,023 | 11/1962 | Schlesinger | 260/240 G |
| 3,697,595 | 10/1972 | Clecak et al. | 260/566 F |
| 3,705,184 | 12/1972 | Goulston et al. | 260/566 F |

*Primary Examiner*—Thomas J. Herbert, Jr.
*Assistant Examiner*—Bruce H. Hess
*Attorney, Agent, or Firm*—Karl F. Jorda; Edward McC. Roberts; Michael W. Glynn

[57] ABSTRACT

Pressure-sensitive copying or recording material which contains, in its color-producing system, as the color former, at least one azomethine compound of the formula (1)

wherein $R_1$, $R_2$, $R_3$ and $R_4$ each represent hydrogen, alkyl of 1 to 4 carbon atoms, cyanoalkyl of 2 to 5 carbon atoms, unsubstituted benzyl or phenyl, or benzyl or phenyl substituted by halogen, alkyl of 1 to 4 carbon atoms or alkoxy of 1 to 4 carbon atoms, or $R_1$ and $R_2$ conjointly represent alkylene of 4 to 5 carbon atoms and/or $R_3$ and $R_4$ conjointly represent alkylene of 4 or 5 carbon atoms, $X_1$ and $X_2$ each represent hydrogen, halogen, alkyl of 1 to 4 carbon atoms or alkoxy of 1 to 4 carbon atoms, A represents naphthylene or phenylene which is unsubstituted or substituted by halogen, alkyl of 1 to 5 carbon atoms, alkoxy of 1 to 4 carbon atoms, phenoxy, halogenophenoxy or acylamino of 1 to 9 carbon atoms, and n is 1 or 2.

13 Claims, No Drawings

PRESSURE-SENSITIVE COPYING OR RECORDING MATERIAL

The subject of the present invention is a pressure-sensitive copying or recording material which contains, in its colour-producing system, as the colour-forming agent, at least one azomethine compound of the formula

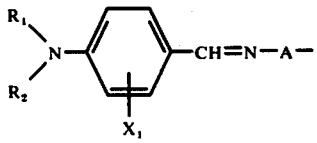

(1)

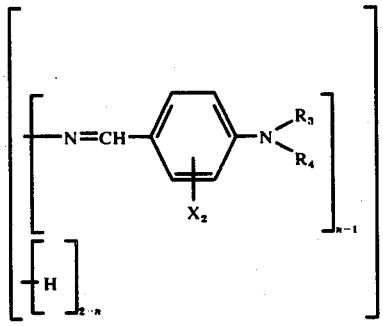

wherein $R_1$, $R_2$, $R_3$ and $R_4$ each denote hydrogen, alkyl with 1 to 4 carbon atoms, cyanoalkyl with 2 to 5 carbon atoms, unsubstituted benzyl or phenyl, or benzyl or phenyl substituted by halogen, alkyl with 1 to 4 carbon atoms or alkoxy with 1 to 4 carbon atoms, or $R_1$ and $R_2$ conjointly denote alkylene with 4 or 5 carbon atoms and/or $R_3$ and $R_4$ conjointly denote alkylene with 4 or 5 carbon atoms, $X_1$ and $X_2$ each denote hydrogen, halogen, alkyl with 1 to 4 carbon atoms or alkoxy with 1 to 4 carbon atoms, A denotes naphthylene or phenylene, which can be further substituted by halogen, alkyl with 1 to 5 carbon atoms, alkoxy with 1 to 4 carbon atoms, phenoxy, halogenophenoxy or acylamino with 1 to 9 carbon atoms, and *n* denotes 1 or 2.

Amongst these compounds of the formula (1), those which are preferred are, above all, those in which $R_1$, $R_2$, $R_3$ and $R_4$ each denote hydrogen, alkyl with 1 to 4 carbon atoms, cyanoalkyl with 2 to 5 carbon atoms, benzyl or phenyl, or $R_1$ and $R_2$ conjointly denote alkylene with 4 or 5 carbon atoms and/or $R_3$ and $R_4$ conjointly denote alkylene with 4 or 5 carbon atoms, $X_1$ and $X_2$ each denote hydrogen, halogen, alkyl with 1 to 4 carbon atoms or alkoxy with 1 to 4 carbon atoms, A denotes naphthylene or phenylene, which is optionally further substituted by halogen, alkyl with 1 to 4 carbon atoms or alkoxy with 1 to 4 carbon atoms, and n denotes 1 or 2.

The radicals $R_1$ and $R_3$, the radicals $R_2$ and $R_4$ and $X_1$ and $X_2$ preferably have the same meaning.

Preferred colour-forming agents correspond to the formula

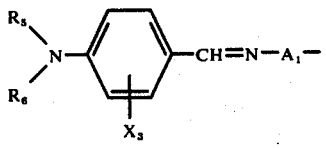

(2)

-continued

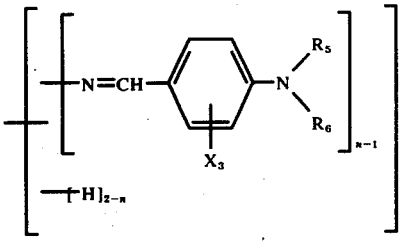

wherein $R_5$ and $R_6$ each denote alkyl with 1 to 4 carbon atoms, benzyl or phenyl or $R_5$ and $R_6$ conjointly denote alkylene with 4 or 5 carbon atoms, $X_3$ denotes hydrogen, alkyl with 1 to 4 carbon atoms or alkoxy with 1 to 4 carbon atoms, $A_1$ denotes phenylene, which can be further substituted by halogen, alkyl with 1 to 5 carbon atoms, alkoxy with 1 to 4 carbon atoms, phenoxy, chlorophenoxy, benzoylamino or alkanoylamino with 2 to 4 carbon atoms, and n denotes 1 or 2.

Advantageous results are achieved with colour-forming agents of one of the formulae (1) or (2) wherein the index n is 1.

Amongst the compounds of the formula (2), those azomethine compounds which are of particular industrial importance, and thus are particularly preferred, can be represented by the following formula (3)

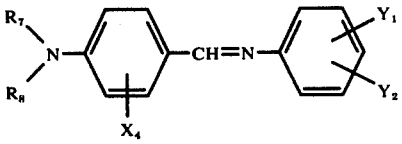

(3)

wherein $R_7$ and $R_8$ each denote alkyl with 1 to 4 carbon atoms or benzyl, $X_4$ denotes hydrogen, halogen, preferably chlorine, or methyl, methoxy or ethoxy, $Y_1$ denotes hydrogen, halogen, methyl, methoxy, phenoxy, chlorophenoxy, benzoylamino or alkanoylamino with 2 to 4 carbon atoms and $Y_2$ denotes hydrogen, halogen, methoxy or alkyl with 1 to 5 carbon atoms.

Pressure-sensitive recording material wherein the colour-forming agent corresponds to the formula

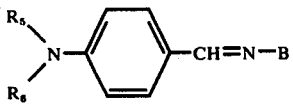

(4)

wherein $R_5$ and $R_6$ each denote alkyl with 1 to 4 carbon atoms, benzyl or phenyl and B denotes phenyl, which can be further substituted by alkyl or alkoxy, each with 1 to 4 carbon atoms, is of particular interest.

Very suitable colour-forming agents correspond to the formula

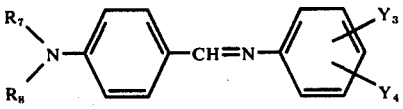

(5)

wherein $R_7$ and $R_8$ each denote alkyl with 1 to 4 carbon atoms or benzyl, $Y_3$ denotes hydrogen, alkyl with 1 to 4 carbon atoms or methoxy and $Y_4$ denotes hydrogen, methyl or methoxy.

The R radicals in the formulae (1) to (5) can differ from one another or, preferably, can be identical. If the R radicals or X radicals denote alkyl, alkyl represents, for example, n-butyl, iso-butyl, tert.-butyl, sec.-butyl, n-propyl, isopropyl or, above all, ethyl or, preferably, methyl. In the definition of the R radicals, cyanoalkyl can, for example, denote 4-cyanobutyl, 3-cyanopropyl or, above all, 2-cyanoethyl. Preferred substituents in the benzyl or phenyl group of the R radicals are, for example, halogens, methyl or methoxy. Examples of such araliphatic and aromatic radicals are o- or p-methylbenzyl, o- or p-chlorobenzyl, o- or p-tolyl, xylyl, o-, m-or p-chlorophenyl and o- or p-methoxyphenyl. If the R radicals conjointly are alkylene, they then form, conjointly with the nitrogen atom to which they are bonded, a heterocyclic ring, such as, for example, a piperidine, pipecoline or pyrrolidine ring.

When one or more of the Y radicals or of the substituents of A represent alkyl, these are the same alkyl radicals as those indicated in the definition of the R and X radicals, and also neopentyl. In the definition of the X radicals and of the substituents of A, the alkoxy radicals are represented by the alkoxy radicals which correspond to the alkyl radicals, such as, for example, methoxy, ethoxy, isopropoxy or tert.-butoxy.

The phenylene radical A can advantageously also contain an acylamino group of 1 to 9 carbon atoms, especially when n is 1. Examples of such acylamino groups which may be mentioned in particular are benzoylamino or alkanoylamino of 2 to 4 carbon atoms, such as acetylamino or propionylamino.

In the context of the above substituents in formulae (1) to (3), halogen is, for example, iodine, fluorine, bromine or, preferably, chlorine.

The present colour-forming agents are in themselves known or are manufactured by known and conventional methods. For example, they can be manufactured by subjecting at least one aldehyde of the formula

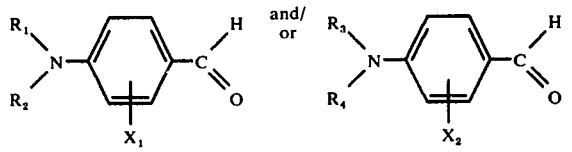

(6.1) (6.2)

wherein $R_1$, $R_2$, $R_3$, $R_4$, $X_1$ and $X_2$ have the indicated meaning, to a condensation reaction with an amine of the formula $$H_2N—A—[NH_2]_{n-1}[H]_{2-n} \quad (7)$$

wherein A and n have the indicated meaning, at elevated temperature, either in the absence of a solvent or, preferably, in an organic solvent, such as in a lower alcohol, for example ethanol. The reaction is preferably carried out in the presence of a catalyst, for example acetic acid or a tertiary amine. If desired, the reaction product of the formula (1) can be further purified by recrystallising it from methanol, ethanol or similar solvents.

The colour-forming agents of the formulae (1) to (5) are usually colourless or at most slightly coloured. When these colour-forming agents are brought into contact with an acid developer, that is to say an electron acceptor, they give intense yellow to orange colour shades which have excellent fastness to light. They are therefore also very valuable as mixtures with other known colour-forming agents, for example crystal violet lactone, 3,3-bis-(1'-n-octyl-2'-methylindol-3'-yl) phthalide, benzyl leucomethylene blue, 3,3-(bis-aminophenyl) phthalides, 2,6-diaminofluoranes, substituted 3-phenyl3-indolyl nitrophthalides and/or other substituted 3,3-bisindolyl phthalides, in order to obtain blue, navy blue, grey or black colorations.

Typical examples of electron acceptors are attapulgus clay, Silton clay, silicon dioxide, bentonite, halloysite, aluminium oxide, aluminium sulphate, aluminium phosphate, zinc chloride, kaolin or any desired acid clay or organic compounds which have an acid reaction, such as, for example, phenols, which are optionally substituted in the ring, salicylic acid or salicylic acid esters and their metal salts and also a polymeric material which has an acid reaction such as, for example, a phenolic polymer, an alkylphenol/acetylene resin, a maleic acid/rosin resin or a partially or completely hydrolysed polymer of maleic anhydride and styrene, ethylene, vinyl methyl ether or carboxypolymethylene.

Preferred coreactants are attapulgus clay, Silton clay or a phenol-formaldehyde resin. These electron acceptors are preferably applied in the form of a layer to the front of the receiving sheet.

Both on clay and on phenolic substrates, the colour-forming agents used according to the invention display an improved fastness to light and colour intensity.

A pressure-sensitive copying or recording material comprises, for example, at least one pair of sheets, which contain at least one colour-forming agent of the formula (1), dissolved in an organic solvent and optionally in micro-capsules which can be broken open by pressure, and a solid electron acceptor. When it comes into contact with the electron acceptor substance, the colour-forming agent gives a coloured mark at the points at which pressure has been applied.

In order to prevent premature activity of these colour-forming agents, which are contained in the pressure-sensitive copying material, they are separated from the electron acceptor substance.

As a rule, this is done by incorporating these colour-forming agents into foam-like, sponge-like or honeycomb-like structures. Preferably, these colour-forming agents are enclosed in micro-capsules.

If the capsules are broken open by pressure, for example by means of a pencil, and if the solution of the colour-forming agent is transferred, in this way, to an adjacent sheet which is coated with a substrate which can act as an electron acceptor, a coloured image is produced. This new colour results from the dyestuff which has thus been formed and which absorbs in the visible region of the electromagnetic spectrum.

The colour-forming agents are preferably encapsulated in the form of solutions in organic solvents. Examples of suitable solvents are non-volatile solvents, for example a polyhalogenated diphenyl, such as trichlorodiphenyl, and a mixture thereof with liquid paraffin, tricresyl phosphate, di-n-butyl phthalate, dioctyl phthalate, trichlorobenzene, nitrobenzene, trichloroethyl phosphate, petroleum ether, hydrocarbon oils, such as paraffin, alkylated derivatives of diphenyl, naphthalene or triphenyl, terphenyl, partially hydrogenated terphenyl or other chlorinated or hydrogenated, condensed, aromatic hydrocarbons.

The walls of the capsules are preferably formed uniformly, by coacervation forces, around the droplets of the solution of the colour-forming agent, the encapsulating material consisting of gelatine, such as is described, for example, in U.S. Pat. No. 2,800,457. The capsules can preferably be formed from an aminoplast or modified aminoplasts by polycondensation, as described in British Patent Specifications 989,264, 1,156,725, 1,301,052, 1,355,124 or 1,389,238.

The micro-capsules containing the colour-forming agents of the formula (1) can be used for the manufacture of pressure-sensitive copying materials of very diverse known types. The various systems essentially differ from one another in the location of the capsules and of the colour reagents and in the carrier material.

A preferred arrangement is that in which the encapsulated colour-forming agent is applied, in the form of a layer, to the rear of a transfer sheet and the electron acceptor substance is applied, in the form of a layer, to the front of a receiving sheet.

In another arrangement of the constituents, the microcapsules containing the colour-forming agent, and the developer, are in or on the same sheet, in the form of one or several separate layers, or in the paper pulp.

Such pressure-sensitive copying materials are described, for example, in U.S. Pat. Nos. 2,730,457, 2,932,582, 3,418,250, 3,418,656, 3,427,180 and 3,516,846. Further systems are described in British Patent Specifications 1,042,596, 1,042,597, 1,042,598, 1,042,599, 1,053,935 and 1,517,650. Micro-capsules which contain the colour-forming agents of the formula (1) are suitable for each of these systems and for other pressure-sensitive systems.

The capsules are preferably fixed to the carrier by means of a suitable adhesive. Since paper is the preferred carrier material, such adhesives are, in the main, paper coating agents, such as gum arabic, polyvinyl alcohol, hydroxymethylcellulose, casein, methylcellulose or dextrin.

The term "paper" which is used here comprises not only normal papers of cellulose fibres but also papers in which the cellulose fibres have been replaced (partially or completely) by fibres of synthetic polymers.

Examples of colour-forming agents of the formula (1) which can be used in the pressure-sensitive materials according to the invention are listed in Table 1.

Table 1

| Colour-forming agent No. | Formula | Colour on Silton clay | λmax. in acetic acid nm |
|---|---|---|---|
| 1 | 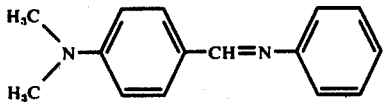 | yellow | 438 |
| 2 | 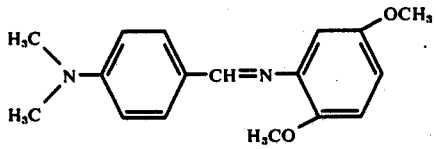 | orange | 455 |
| 3 | 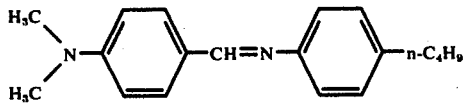 | yellow | 440 |
| 4 | 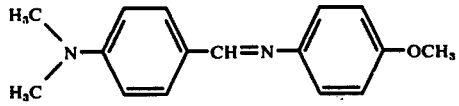 | orange | 445 |
| 5 | 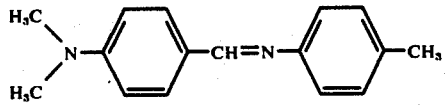 | yellow | 440 |
| 6 | 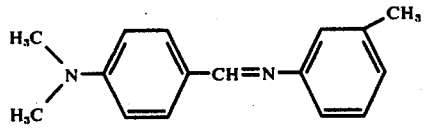 | yellow | 439 |
| 7 | 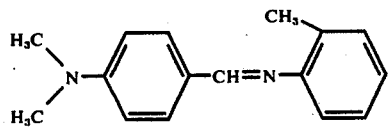 | yellow | 422 |
| 8 | 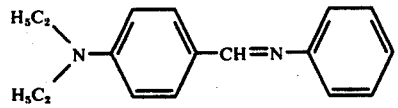 | yellow | 441 |

Table 1-continued
| Colour-forming agent No. | Formula | Colour on Silton clay | λmax. in acetic acid nm |
|---|---|---|---|
| 9 | 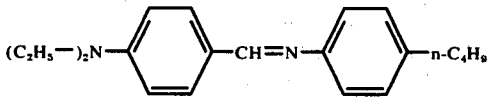 Melting point 65–65.5° C | yellow | 440 |
| 10 | 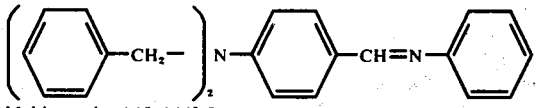 Melting point 145–146° C | yellow | 435 |
| 11 | 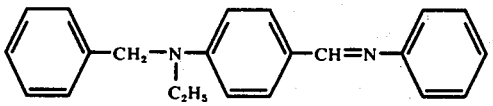 | yellow | — |
| 12 | 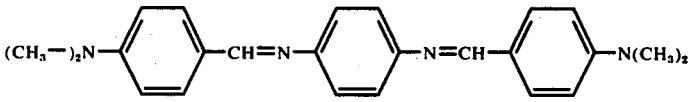 Melting point 250° C (decomposition) | orange | 454 |
| 13 | 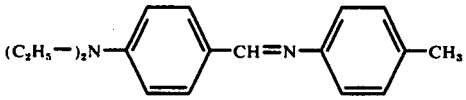 | yellow | 443 |
| 14 | 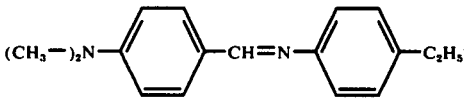 | yellow | 440 |
| 15 | 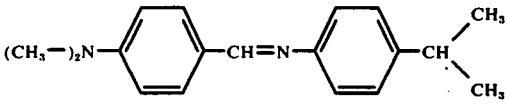 | yellow | 442 |
| 16 | 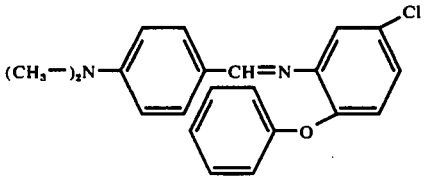 | yellow | 444 |
| 17 | 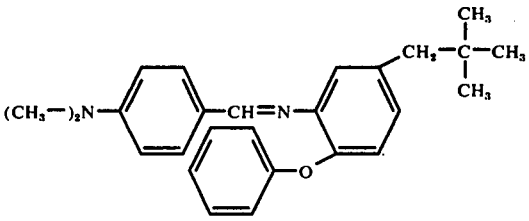 | yellow | 440 |
| 18 | 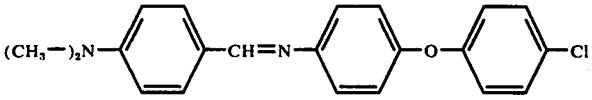 | yellow | 445 |
| 19 | 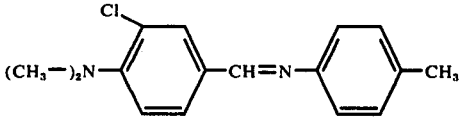 | yellow | 446 |

Table 1-continued

| Colour-forming agent No. | Formula | Colour on Silton clay | λmax. in acetic acid nm |
|---|---|---|---|
| 20 | 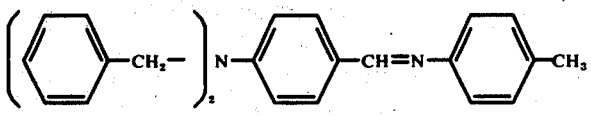 | yellow | 438 |
| 21 | 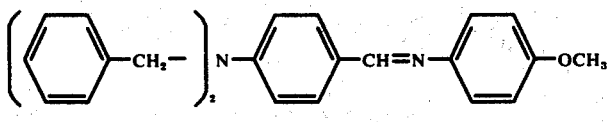 | yellow | 442 |
| 22 | 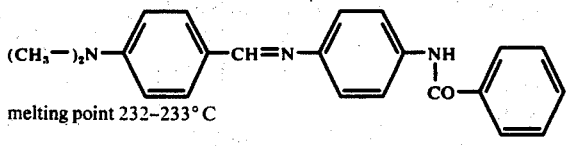 melting point 232–233° C | yellow | 451 |
| 23 | 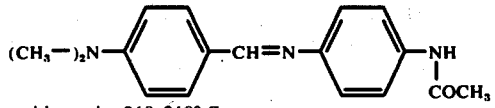 melting point 218–219° C | yellow | 449 |
| 24 | 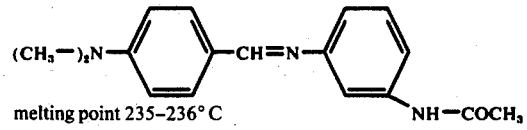 melting point 235–236° C | yellow | 442 |
| 25 | 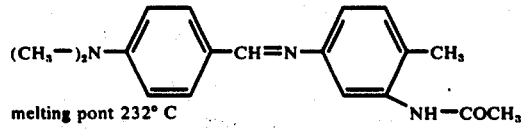 melting pont 232° C | yellow | 442 |
| 26 | 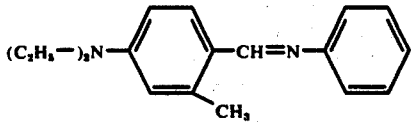 | yellow | 447 |
| 27 | 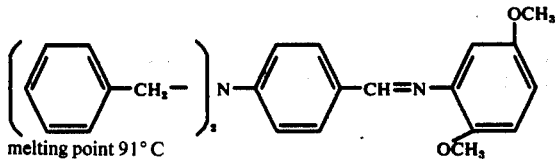 melting point 91° C | orange | 455 |

In the manufacturing instructions and examples which follow, the percentages, unless otherwise stated, are by weight.

MANUFACTURING INSTRUCTIONS

A. 7.5 g of 4-dibenzylaminobenzaldehyde and 3.72 g of 2,5-dimethoxy-aniline in 25 ml of methanol are heated under reflux for 3 hours. The hot reaction solution is then cooled and the precipitate is filtered off. The latter is washed with methanol and dried in vacuo at 60° C. 7.4 g of an azomethine compound of the formula

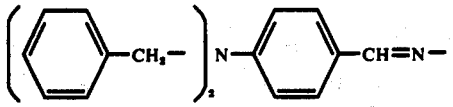

(27)

-continued

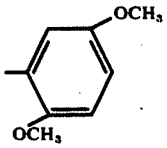

are obtained. This compound melts at 91° C. A solution of this compound in 95% strength acetic acid has a λmax at 455 nm. On Silton clay, this azomethine compound develops an orange colour shade. B. If, in manufacturing instruction A, the 4-dibenzylaminobenzaldehyde and the 2,5-dimethoxy-aniline are replaced by equivalent amounts of corresponding benzaldehyde compounds and amino compounds, the azomethine compounds Nos. 1 to 26, which are listed in Table 1 above, are obtained.

EXAMPLE 1

A solution of 3 g of colour-forming agent No. 1 in Table 1, in 97 g of partially hydrogenated terphenyl, is emulsified in a solution of 12 g of pigskin gelatine in 88 g of water at 50° C. A solution of 12 g of gum arabic in 88 g of water at 50° C is then added. The emulsion is diluted by adding 200 ml of water at 50° C and coacervation is effected by pouring the resulting emulsion into 600 g of ice water and stirring the mixture for 3 hours. A paper is coated with the suspension of micro-capsules thus obtained and dried. When the coated side of this paper is laid on a sheet of paper coated with attapulgus clay, Silton clay or a phenolic resin and the top sheet is written on by hand or using a typewriter, a yellow copy is obtained on the co-reactive sheet and the developed image displays an excellent fastness to light.

Corresponding effects can also be achieved when any of the other colour-forming agents in Table 1 are used.

EXAMPLE 2

The following colour-forming agents: 2.4 g of a mixture of the 3-(2'-ethoxy-4'-diethylaminophenyl)-2-(1'λ'-ethyl-2''-methylindol-3''-yl)-5- and -6-nitrophthalide isomers, 0.54 g of 3,3-bis-(1'-n-octyl-2'-methylindol-3'-yl) phthalide and 0.06 g of the colour-forming agent No. 1 in Table 1, are dissolved in 97 g of partially hydrogenated terphenyl.

This solution of colour-forming agents is encapsulated by the coacervation method as indicated in Example 1.

A paper is also coated with the capsule mass, in the same way as indicated in Example 1. When, by applying pressure by means of a pencil, this paper is brought into contact with a paper coated with Silton Clay, a stable, deep blue image is obtained.

EXAMPLE 3

The same colour-forming agents as those indicated in Example 2 are dissolved and encapsulated. A paper is then coated with the capsule mass. The weight ratio is, however, 3:0.2:0.05 instead of 2.4:0.54:0.6.

When the coated paper is laid on a paper coated with Silton clay and pressure is applied by writing with a pencil, a stable, black image is formed.

We claim:

1. Pressure-sensitive copying or recording material which contains, in its colour-producing system, as the colour former, at least one azomethine compound of the formula

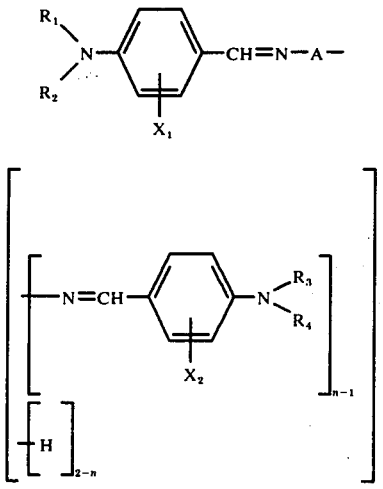

(1)

wherein $R_1$, $R_2$, $R_3$ and $R_4$ each represent hydrogen, alkyl of 1 to 4 carbon atoms, cyanoalkyl of 2 to 5 carbon atoms, unsubstituted benzyl or phenyl, or benzyl or phenyl substituted by halogen, alkyl of 1 to 4 carbon atoms or alkoxy of 1 to 4 carbon atoms, or $R_1$ and $R_4$ conjointly represent alkylene of 4 or 5 carbon atoms and/or $R_3$ and $R_4$ conjointly represent alkylene of 4 or 5 carbon atoms, $X_1$ and $X_2$ each represent hydrogen, halogen, alkyl of 1 to 4 carbon atoms or alkoxy of 1 to 4 carbon atoms, A represents naphthylene or phenylene which is unsubstituted or substituted by halogen, alkyl of 1 to 5 carbon atoms, alkoxy of 1 to 4 carbon atoms, phenoxy, halogenophenoxy or acylamino of 1 to 9 carbon atoms, and *n* is 1 or 2.

2. Material according to claim 1, wherein the colour former corresponds to the formula (1), wherein the index *n* is 1.

3. Material according to claim 1, wherein the colour former corresponds to the formula (1), wherein $R_1$, $R_2$, $R_3$ and $R_4$ each represent hydrogen, alkyl of 1 to 4 carbon atoms, cyanoalkyl of 2 to 5 carbon atoms, benzyl or phenyl, or $R_1$ and $R_2$ conjointly represent alkylene of 4 or 5 carbon atoms and/or $R_3$ and $R_4$ conjointly represent alkylene of 4 or 5 carbon atoms, $X_1$ and $X_2$ each represent hydrogen, halogen, alkyl of 1 to 4 carbon atoms or alkoxy of 1 to 4 carbon atoms, A represents naphthylene or phenylene which is unsubstituted or substituted by halogen, alkyl of 1 to 4 carbon atoms or alkoxy of 1 to 4 carbon atoms, and *n* is 1 or 2.

4. Material according to claim 1, wherein the colour former corresponds to the formula

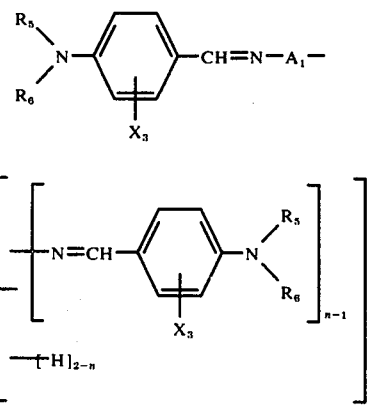

(2)

wherein $R_5$ and $R_6$ each represent alkyl of 1 to 4 carbon atoms, benzyl or phenyl or $R_5$ and $R_6$ conjointly represent alkylene of 4 or 5 carbon atoms, $X_3$ represents hydrogen, alkyl of 1 to 4 carbon atoms or alkoxy of 1 to 4 carbon atoms, $A_1$ represents phenylene which is unsubstituted or substituted by halogen, alkyl of 1 to 5 carbon atoms, alkoxy of 1 to 4 carbon atoms, phenoxy, chlorophenoxy, benzoylamino or alkanoylamino of 2 to 4 carbon atoms, and $n$ is 1 or 2..

5. Material according to claim 4, wherein the colour former corresponds to the formula (2) wherein the index $n$ is 1.

6. Material according to claim 5, wherein the colour former corresponds to the formula

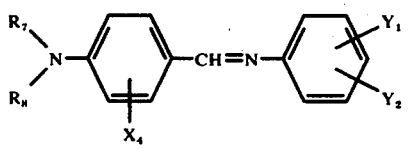

(3)

wherein $R_7$ and $R_8$ each represent alkyl of 1 to 4 carbon atoms or benzyl, $X_4$ represents hydrogen, halogen, methyl, methoxy or ethoxy, $Y_1$ represents hydrogen, halogen, methyl, methoxy, phenoxy, chlorophenoxy, benzoylamino or alkanoylamino of 2 to 4 carbon atoms and $Y_2$ represents hydrogen, halogen, methoxy or alkyl of 1 to 5 carbon atoms.

7. Material according to claim 5, wherein the colour former corresponds to the formula

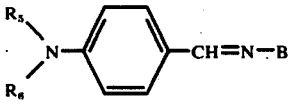

(4)

wherein $R_5$ and $R_6$ each represent alkyl of 1 to 4 carbon atoms, benzyl or phenyl and B represents phenyl which is unsubstituted or substituted by alkyl of 1 to 4 carbon atoms or by alkoxy of 1 to 4 carbon atoms.

8. Material according to claim 7, wherein the colour former corresponds to the formula

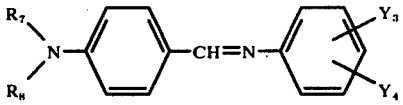

(5)

wherein $R_7$ and $R_8$ each represent alkyl of 1 to 4 carbon atoms or benzyl, $Y_3$ represents hydrogen, alkyl of 1 to 4 carbon atoms or methoxy and $Y_4$ represents hydrogen, methyl or methoxy.

9. Material according to claim 1 which contains at least one azomethine compound of the formula (1), dissolved in an organic solvent, and an electron acceptor substance.

10. Material according to claim 1, wherein the colour former, dissolved in an organic solvent, is contained in pressure-rupturable micro-capsules.

11. Material according to claim 9 wherein the electron acceptor substance is attapulgus clay, silton clay or a phenolformaldehyde resin.

12. Material according to claim 10, wherein the encapsulated colour former is coated on one side of a transfer sheet and the electron acceptor substance is coated on one side of a second (receiving) sheet, the sheets being arranged such that in use the coated sides contact each other.

13. Material according to claim 1, wherein the colour former is contained together with one or more other colour formers.

* * * * *

UNITED STATES PATENT OFFICE
CERTIFICATE OF CORRECTION

PATENT NO. : 4,025,089

DATED : May 24, 1977

INVENTOR(S) : ROBERT GARNER ET AL.

It is certified that error appears in the above-identified patent and that said Letters Patent are hereby corrected as shown below:

Col. 12, line 7, delete"$R_4$" and substitute -- $R_2$ --.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*